US007128486B2

(12) United States Patent
Ohba et al.

(10) Patent No.: US 7,128,486 B2
(45) Date of Patent: Oct. 31, 2006

(54) STICK-FORM COSMETIC MATERIAL FEEDING CONTAINER

(75) Inventors: Atsushi Ohba, Tokyo (JP); Tomoya Minamino, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/349,107

(22) Filed: Feb. 8, 2006

(65) Prior Publication Data

US 2006/0198688 A1 Sep. 7, 2006

(30) Foreign Application Priority Data

Mar. 2, 2005 (JP) ..... 2005-057194
May 9, 2005 (JP) ..... 2005-136202

(51) Int. Cl.
*A45D 40/20* (2006.01)
*A45D 40/04* (2006.01)

(52) U.S. Cl. ..... 401/88; 401/75

(58) Field of Classification Search ..... 401/68, 401/75, 78, 88, 171, 172, 173, 174, 176, 401/177
See application file for complete search history.

(56) References Cited

U.S. PATENT DOCUMENTS 5,871,295 A * 2/1999 Bouix ..... 401/78
5,888,004 A * 3/1999 Bouix ..... 401/87

FOREIGN PATENT DOCUMENTS

JP 07-024216 5/1995
JP 2002-262936 9/2002

* cited by examiner

*Primary Examiner*—David J. Walczak
(74) *Attorney, Agent, or Firm*—Rabin & Berdo, P.C.

(57) ABSTRACT

A feeding container (1, 101, 301) for a stick-form cosmetic material (A, B, C) comprises a sleeve (10, 110, 310) which accommodates a tubular holder (31, 131, 331) holding the base end of the stick-form cosmetic material (A, B, C). By constituting the holder (31, 131, 331) by a thin film, an appropriate clearance can be set between the cosmetic material (A, B, C) and the inner periphery of the sleeve (10, 110, 310) without providing a step in the outer periphery of the cosmetic material (A, B, C). The form of an opening portion of the holder (31, 131, 331) is corrected by the inner periphery of the sleeve (10, 110, 310) when the holder (31, 131, 331) is inserted into the sleeve (10, 110, 310), so the cosmetic material (A, B, C) can be fitted easily into the holder (31, 131, 331) in the sleeve (10, 110, 310).

8 Claims, 11 Drawing Sheets

STICK-FORM COSMETIC MATERIAL FEEDING CONTAINER

FIELD OF THE INVENTION

This invention relates to a container for feeding a stick-form cosmetic material such as lipstick or solid rouge.

BACKGROUND OF THE INVENTION

In relation to a feeding container for a stick-form cosmetic material such as lipstick, JP2002-262936A and JP07-024216U, published by the Japan Patent Office in 2002 and 1995 respectively, disclose containers in which a stick-form cosmetic material is inserted through a tip end opening of a sleeve, the cosmetic material is held within the sleeve, and the cosmetic material is fed by rotating a main body tube relative to the sleeve.

An example of this prior art will now be described with reference to FIGS. 11A–11D. This example corresponds to a third embodiment of JP2002-262936A.

A stick-form cosmetic material P shown in FIG. 11C has a circular cross-section, and is accommodated on the inside of a sleeve 210 shown in FIG. 11A The top end of the stick-form cosmetic material P is cut crossways at an incline. A main body tube 220 is joined to a lower end of the sleeve 210. This joint permits relative rotation between the sleeve 210 and main body tube 220 while restricting relative axial displacement.

As shown in FIG. 11C, the stick-form cosmetic material P decreases in diameter at a midway step 270. Referring to FIG. 11D, a narrow diameter portion 271 below the step 270 is inserted into a holder 231 of a core chuck member 230 which protrudes into the main body tube 220 from the sleeve 210. Engaging protrusions 239 which engage with vertical grooves 212 formed in the inner peripheral surface of the sleeve 210 are formed on the outer periphery of the holder 231 at equal angular intervals. The engagement between the engaging protrusions 239 and vertical grooves 212 restricts relative rotation between the holder 231 and sleeve 210, but permits relative axial displacement.

The core chuck member 230 comprises a stick shaft 234 fixed to a bottom surface of the holder 231 and protruding into the inside of the main body tube 220.

A male screw is carved into the outer periphery of the stick shaft 234, and this male screw is screwed into a female screw formed on the inside of the main body tube 220. Hence, by rotating the main body tube 220 relative to the sleeve 210, the holder 231 is axially displaced while supporting the stick-form cosmetic material P.

SUMMARY OF THE INVENTION

The holder 231 is made to have a rigidity high enough to prevent deformation in a self-supported state.

The outer diameter dimension of the holder 231 is set in advance to ensure that the outer periphery does not contact the sleeve 210. If the high-rigidity holder 231 contacts the sleeve 210 during displacement, resistance to the feeding and withdrawal of the stick-form cosmetic material increases, making it difficult to feed and withdraw the cosmetic material smoothly. Further, when the holder 231 and sleeve 210 interfere, the cosmetic material may slant or become damaged.

To increase the rigidity of the holder 231, the wall thickness of the holder 231 must be increased. To secure an appropriate clearance between the stick-form cosmetic material P and sleeve 210 for this purpose, the step 270 must be formed on the stick-form cosmetic material P.

The stick-form cosmetic material is molded using a segment die, and therefore a special formula must be applied during molding to alter the diameter of the cosmetic material midway. Another problem with a stepped stick-form cosmetic material is that the material breaks easily at the stepped part.

It is therefore an object of this invention to provide a feeding container which does not require that a step be formed in a stick-form cosmetic material.

In order to achieve the above object, this invention provides a feeding container for a stick-form cosmetic material, comprising a main body tube, a sleeve connected with the main body tube so as to be free to rotate but not to be detachable therefrom, a core chuck member accommodated in the main body tube and the sleeve, a mechanism that feeds and retrieves the core chuck member according to the relative rotation of the sleeve and the main body tube, and, a tubular holder supported at a tip of the core chuck member inside the sleeve. The tubular holder comprises a thin film that is capable of elastic deformation, and having an opening portion which in a free condition takes a dissimilar form to the cross-section of the stick-form cosmetic material and the sleeve has such a configuration that forcibly corrects the form of the opening portion of the tubular holder such that stick-form cosmetic material can be inserted into the tubular holder.

The details as well as other features and advantages of this invention are set forth in the remainder of the specification and are shown in the accompanying drawings.

DESCRIPTION OF THE PREFERRED EMBODIMENTS

Figure 1:
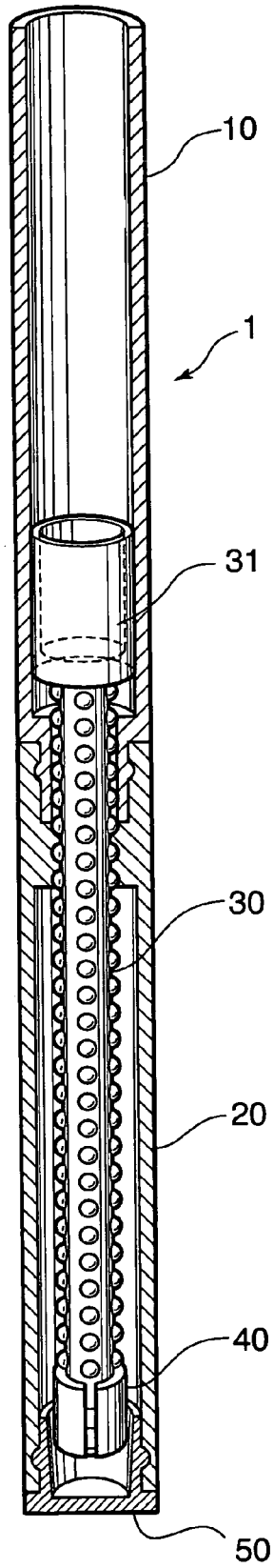
FIG. 1 is a perspective view of a longitudinal section of a stick-form cosmetic material feeding container according to this invention.

Referring to FIG. 1 of the drawings, a stick-form cosmetic material feeding container 1 according to this invention comprises a sleeve 10, a main body tube 20, a core chuck member 30, a latch 40, and a tail plug 50.

Figure 2B:
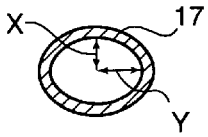
FIGS. 2A–2G are exploded perspective views and main-part sectional views of the stick-form cosmetic material feeding container.
Figure 2A:
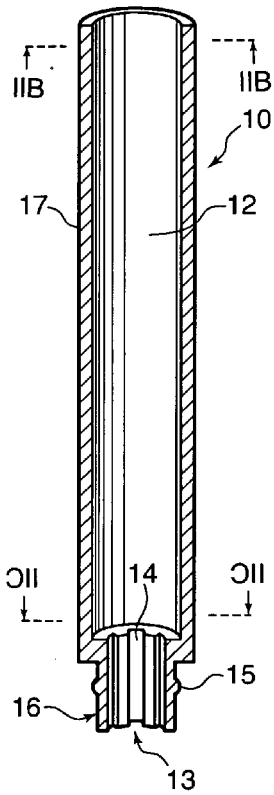
Figure 2D:
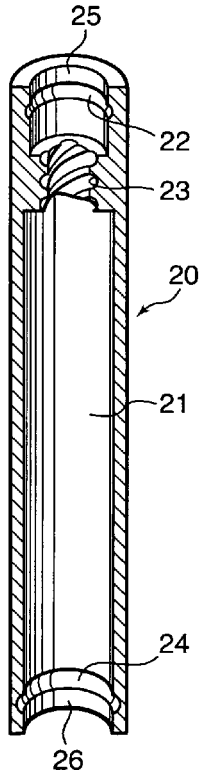
Figure 2E:
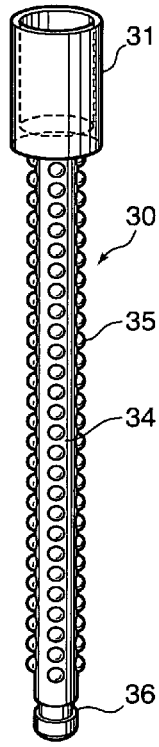
Figure 2F:
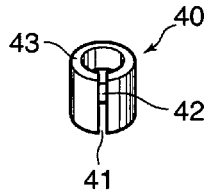
Figure 2G:
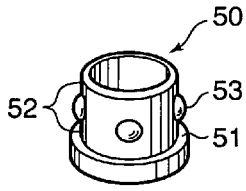
Figure 2C:
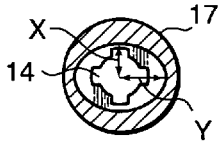

Referring to FIGS. 2A–2C, the sleeve 10 is constituted by a tubular stem portion 17 and a joint portion 16 formed integrally with a lower end of the stem portion 17. When manipulating the stick-form cosmetic material feeding container 1, the stem portion 17 is gripped with the fingers and rotated relative to the main body tube 20. As shown in FIG. 2B, a hollow portion 12 on the inside of the stem portion 17 is formed with an elliptical cross-section having a minor axis X and a major axis Y. The outer periphery of the bottom portion of the stem portion 17 is formed in a circular shape, as shown in FIG. 2C. The wall thickness of the stem portion 17 at the lower end is therefore not uniform.

The joint portion 16 takes a cylindrical form having a smaller diameter than that of the stem portion 17. Engaging protrusions 15 are formed to protrude from the outer periphery of the joint portion 16. The joint portion 16 comprises an axial through hole 13. The basic cross-section of the through hole 13 is circular, and four rotation-preventing grooves 14 are formed in the inner periphery of the through hole 13, at equal angular intervals in the axial direction.

Referring to FIG. 2D, the main body tube 20 takes a cylindrical form having a uniform circular cross-section. The upper end of the main body tube 20 is formed with an upper end opening portion 25 into which the joint portion 16 of the sleeve 10 is fitted. The inner periphery of the upper end opening portion 25 is formed with an annular fitting groove 22 into which the engaging protrusions 15 are fitted. The main body tube 20 also comprises a female screw portion 23 below the upper end opening portion 25. The female screw portion 23 is formed with a smaller diameter than the upper end opening portion 25, and a spiral groove is carved into its inner periphery. A hollow portion 21 having a circular cross-section is formed below the female screw portion 23 of the main body tube 20.

A rear end opening portion 26 which communicates with the hollow portion 21 is formed in the lower end of the main body tube 20. The tail plug 50 shown in FIG. 2G is fitted into the rear end opening portion 26. The tail plug 50 is constituted by a cylindrical portion 52, a flange 51 formed integrally with and having a larger diameter than the lower end of the cylindrical portion 52, and a plurality of protrusions 53 formed on the outer periphery of the cylindrical portion 52. Referring back to FIG. 2D, the inner periphery of the rear end opening portion 26 is formed with an annular fitting groove 24 into which the protrusions 53 are fitted.

Referring to FIGS. 2E and 2F, the core chuck member 30 is constituted by a stick shaft 34 and a holder 31 fixed to the upper end of the stick shaft 34. A large number of male screw-form protrusions 35 is formed on the outer periphery of the stick shaft 34. The male screw-form protrusions 35 are formed at equal intervals along a spiral path so as to fit into the female screw portion 23 of the main body tube 20.

Figure 3B:
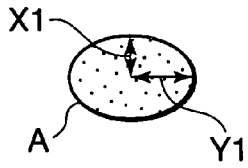
FIGS. 3A–3F are perspective views and main-part sectional views of a stick-form cosmetic material and a holder according to this invention.
Figure 3D:
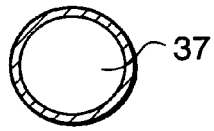
Figure 3A:
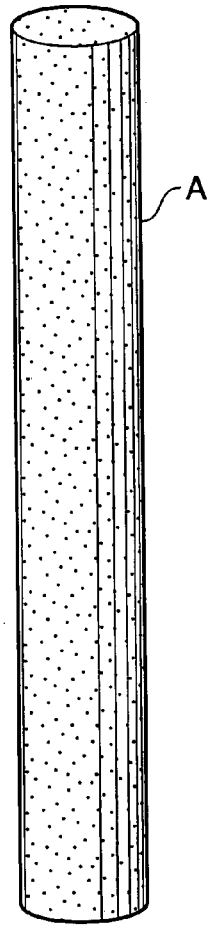
Figure 3C:
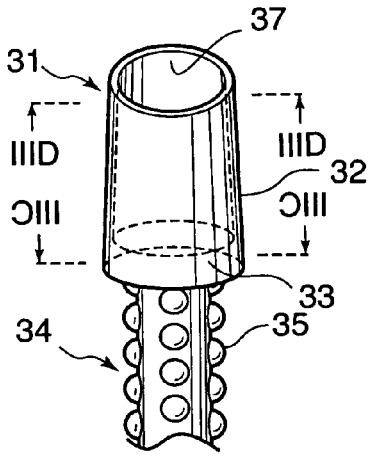

Referring to FIG. 3C. the holder 31 is constituted by a cylindrical portion 32 formed from a thin film, and a thick bottom portion 33 formed integrally with the cylindrical portion 32 so as to seal the lower end of the cylindrical portion 32. The core chuck member 30, including the holder 31 and stick shaft 34, is formed by injection-molding a thermoplastic material. The cylindrical portion 32 comprises an opening portion 37 in its upper end.

Referring again to FIGS. 2E and 2F, the stick shaft 34 is fixed to the bottom portion 33. The lower end of the stick shaft 34 is formed with a recessed portion 36 for latching the latch 40. The latch 40 is a tubular member provided with a slit 41, and comprises protrusions 42 which engage with the recessed portion 36 on its inner periphery. The latch 40 is attached to the lower end of the stick shaft 34 from below so that the slit 41 is pushed open.

Next, referring to FIGS. 3A–3F, the form and dimensions of the holder 31 and a stick-form cosmetic material A held by the holder 31 will be described in detail.

The inner periphery of the cylindrical portion 32 of the holder 31 is formed with an elliptical cross-section having a minor axis X1 and a major axis Y1. The outer periphery of the holder 31, including the bottom portion 33, is formed with an elliptical cross-section having a minor axis X2 and a major axis Y2. The cylindrical portion 32 of the holder 31 is constituted by a thin film and can therefore be deformed through the application of external force. On the other hand, the thick bottom portion 33 has a higher degree of rigidity than the cylindrical portion 32.

The stick-form cosmetic material A is molded in advance into a member having a uniform elliptical cross-section which is identical to that of the opening portion 37 in the upper end of the holder 31, i.e. having a minor axis X1 and a major axis Y1. After assembling the stick-form cosmetic material feeding container 1, the base end of the stick-form cosmetic material is fitted into the holder 31.

An example of the elliptical dimensions X, X1, X2 and Y, Y1, Y2 of each portion will now be provided.

The minor axis X1 of the ellipse formed by the cross-section of the stick-form cosmetic material A, shown in FIG. 3B is set at 8 millimeters (mm), and the major axis Y1 of this ellipse is set at 12 mm. The thickness of the thin film constituting the cylindrical portion 32 of the holder 31 is set at an average of 0.15 mm. The cross-section of the outer periphery of the holder 31, including the bottom portion 33, is formed as an ellipse with the minor axis X2 set at 8.15 mm, and the major axis Y2 set at 12.15 mm. The cross-section of the inner periphery of the upper end opening portion of the sleeve 10, shown in FIG. 2B, is formed as an ellipse with the minor axis X set at 8.2 mm, and the major axis Y set at 12.2 mm. The difference in dimension between the inner periphery of the upper end opening portion of the sleeve 10 and the cross-section of the stick-form cosmetic material A is set to a value which takes into consideration the minimum gap between the wall surface of the sleeve 10 and the stick-form cosmetic material A required to ensure that the stick-form cosmetic material A in the hollow portion 12 of the sleeve 10 can move up and down through the upper end opening portion without contacting the wall surface of the sleeve 10. The inner periphery of the bottom portion of the hollow portion 12 is formed as the same ellipse as that of the upper end opening portion.

The stick-form cosmetic material feeding container 1 is assembled according to the following sequence.

First, the core chuck member 30 is inserted from the stick shaft 34 into the tip end opening portion of the sleeve 10. The stick shaft 34 is passed downward from the through hole 13 until the bottom portion 33 of the holder 31 contacts the bottom surface of the hollow portion 12. At this time, the male screw-form protrusions 35 pass through the inside of the rotation preventing grooves 14. Next, the stick shaft 34 protruding from the sleeve 10 is inserted into the main body tube 20 from the upper end opening portion 25.

At this time, the stick shaft 34 is inserted into the main body tube 20 while rotating the main body tube 20 and the stem portion 17 of the sleeve 10 relative to each other so that the male screw-form protrusions 35 pass through the female screw portion 23. When the stick shaft 34 has been inserted as far as possible into the main body tube 20 in this manner, the joint portion 16 of the sleeve 10 is pushed into the upper end opening portion 25 of the main body tube 20 so that the engaging protrusions 15 engage with the fitting groove 22.

As a result of this operation, the sleeve 10 and main body tube 20 are joined so as to be capable of relative rotation and such that the sleeve 10 is prevented from falling out of the main body tube 20.

Next, the latch 40 is attached to the lower end of the stick shaft 34 from the rear end opening portion 26 such that the protrusions 42 engage with the recessed portion 36.

Finally, the tail plug 50 is pushed into the rear end opening portion 26 of the main body tube 20 so that the protrusions 53 engage with the fitting groove 24, and thus the tail plug 50 is attached to the main body tube 20.

When assembly of the stick-form cosmetic material feeding container 1 is complete, the sleeve 10 and the main body tube 20 are relatively rotated so as to advance the holder 31 to the most advanced position, and the stick-form cosmetic material A is inserted into the cylindrical portion 32 of the holder 31 within the sleeve 10 from the tip end opening portion of the sleeve 10. Having been inserted into the cylindrical portion 32, the stick-form cosmetic material A is held inside the cylindrical portion 32 by frictional force generated between the cylindrical portion 32 and stick-form cosmetic material A.

Next, referring back to FIG. 1, an operation of the stick-form cosmetic material feeding container 1 will be described. When a user of the stick-form cosmetic material rotates the sleeve 10 and main body tube 20 relative to each other, the stick shaft 34 of the core chuck member 30, the male screw-form protrusions 35 of which are engaged with the rotation-preventing grooves 14 in the through hole 13, rotates integrally with the sleeve 10 relative to the main body tube 20. Meanwhile, the male screw-form protrusions 35 on the stick shaft 34 are engaged with the inside of the female screw portion 23 below the through hole 13. Hence, when the stick shaft 34 rotates relative to the main body tube 20, the male screw-form protrusions 35 are spirally displaced along the groove of the female screw portion 23.

As described above, the sleeve 10 is prevented from falling out of the main body tube 20 by means of the joint between the upper end opening portion 25 and the joint portion 16. Therefore, as the male screw-form protrusions 35 are displaced spirally along the female screw portion 23, the stick shaft 34 is unscrewed axially so that the holder 31 fixed to the stick shaft 34 rises within the sleeve 10, and the stick-form cosmetic material A, the base end of which is held by the holder 31, advances to the outside through the upper end opening portion of the sleeve 10. Conversely, when the sleeve 10 and main body tube 20 are rotated relative to each other in reverse, the male screw-form protrusions 35 are displaced along the groove of the female screw portion 23 in reverse, and hence the holder 31 fixed to the tip end of the stick shaft 34 retreats downward into the interior of the sleeve 10, thereby withdrawing the stick-form cosmetic material A into the sleeve 10.

In the stick-form cosmetic material feeding container 1 as described above, the cylindrical portion 32 of the holder 31 which holds the stick-form cosmetic material A is constituted by a thermoplastic thin film, and hence the step on the outer periphery of the stick-form cosmetic material A can be eliminated while maintaining an appropriate clearance between the stick-form cosmetic material A and the inner periphery of the sleeve 10.

Figure 3F:
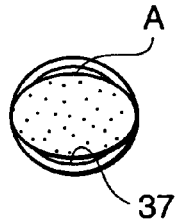
Figure 3E:
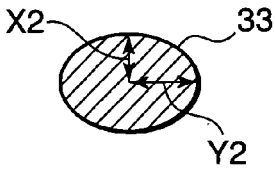
Figure 4:
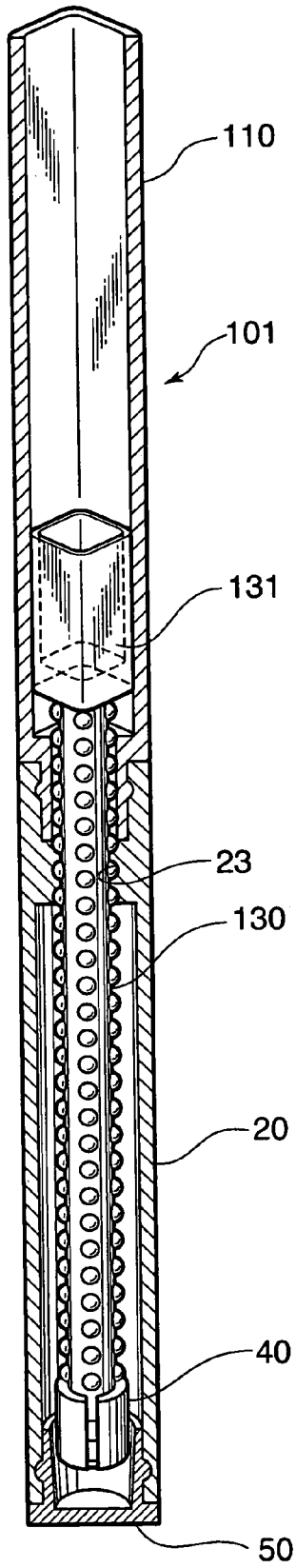
FIG. 4 is similar to FIG. 1, but shows a second embodiment of this invention.

As described above, the core chuck member 30, including the holder 31 and stick shaft 34, is formed by injection-molding a thermoplastic material. Accordingly, as shown in FIG. 3D, the inner periphery of the upper end opening portion 37 in the cylindrical portion 32 of the holder 31, which is defined by the plastic thin film, tends to have a sectional form that is closer to a circular form than the designed elliptical cross-section. This difference in form causes an obstruction when the stick-form cosmetic material A is inserted into the cylindrical portion 32 through the upper end opening portion 37 as shown in FIG. 3F.

Further, the cylindrical portion 32 of the holder 31 has a wall thickness of 0.15 mm, which is much thinner than the thick bottom portion 33. Hence, when molding the core chuck member 30 by injection-molding the thermoplastic material, the plastic material may suffer the effects of extreme variation in internal stress, variation in the pressure or speed at which the material flows, and slight bias in the material in the die, leading to variation in the thickness of the wall surface of the cylindrical portion 32.

For the reasons described above, the upper end opening portion 37 of the holder 31 may have a cross-section which is closer to a circle than the designed elliptical cross-section. According to this invention, however, when the core chuck member 30 is inserted into the sleeve 10 during assembly of the stick-form cosmetic material feeding container 1, the outer periphery of the deformed upper end opening portion 37 of the holder 31 contacts the inner periphery of the sleeve 10, which has an elliptical cross-section, and hence the form of the cylindrical portion 32 of the holder 31 is corrected by the sleeve 10 such that the upper end opening portion 37 takes a similar, elliptical sectional form to the inner peripheral surface of the sleeve 10. As a result, when the stick-form cosmetic material A is attached to the holder 31 after the stick-form cosmetic material feeding container 1 is assembled, the upper end opening portion 37 of the holder 31 does not cause an obstruction when the stick-form cosmetic material A is inserted into the cylindrical portion 32. Once the stick-form cosmetic material A is inserted into the cylindrical portion 32 of the holder 31, the form of the cylindrical portion 32 is further corrected by the stick-form cosmetic material A.

It is also preferable for the empty holder 31 to contact the inner periphery of the sleeve 10 to prevent the holder 31 from falling out of the sleeve 10 during the assembly operation. Moreover, when the holder 31 is in contact with the inner periphery of the sleeve 10, the stick-form cosmetic material A can be prevented from swaying in a horizontal direction during feeding and withdrawal operations. Moreover, even if the feeding pitch of the stick-form cosmetic material A is coarse due to the engagement between the male screw-form protrusions 35 and the female screw portion 23, the stick-form cosmetic material A does not fall out of the sleeve 10 under its own weight, or due to vibration or movement, when the stick-form cosmetic material feeding container 1 is oriented downward. Hence the stick-form cosmetic material feeding container 1 may be provided with a favorable operating sensation.

The cylindrical portion 32 formed by the plastic thin film possesses elasticity, and therefore provides only an appropriate degree of frictional resistance even when displaced while in contact with the inner periphery of the sleeve 10. Hence, the unpleasant sensation produced when the cylindrical portion 32 is constituted by a highly rigid member by the contact between the cylindrical portion and sleeve 10 during a feeding or withdrawal operation is eliminated.

Next, referring to FIG. 4, FIGS. 5A–5D, and FIGS. 6A–6F, a second embodiment of this invention will be described.

A stick-form cosmetic material feeding container 101 according to this embodiment comprises a sleeve 110 and a core chuck member 130 that are different to those of the first embodiment. The main body tube 20, latch 40, and tail plug 50 are identical to those of the first embodiment.

The stick-form cosmetic material feeding and withdrawal mechanisms are identical to those of the first embodiment. More specifically, male screw-form protrusions 135 on the outer periphery of a stick shaft 134 of the core chuck member 130 are displaced spirally along the inside of the female screw portion 23 in the main tube body 20 when the sleeve 110 and main tube body 20 are rotated relative to each other. Meanwhile, the male screw-form protrusions 135 are engaged with a rotation-preventing groove 114 formed in the inner periphery of a through hole 113, thereby restricting relative rotation between the core chuck member 130 and sleeve 110. As a result, a stick-form cosmetic material B held in a holder 131 on the upper end of the core chuck member 130 is fed out from the sleeve 110 when the main tube body 20 is rotated relative to the sleeve 110, and the stick-form cosmetic material B is withdrawn into the sleeve 110 when the main tube body 20 is rotated relative to the sleeve 110 in reverse.

Figure 5B:
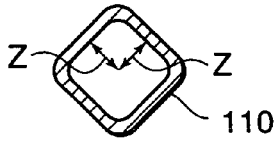
FIGS. 5A–5D are exploded perspective views and main-part sectional views of a stick-form cosmetic material feeding container according to the second embodiment of this invention.
Figure 5A:
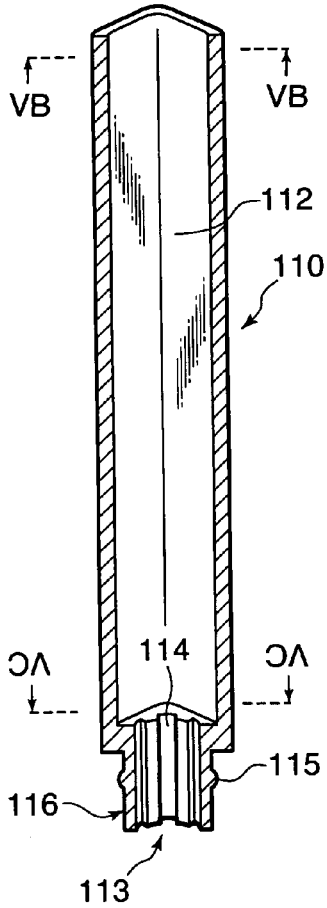
Figure 5D:
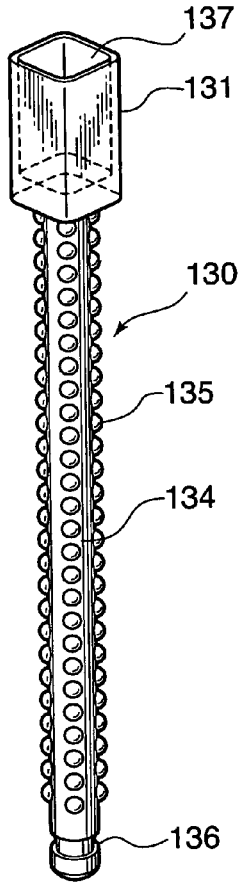
Figure 5C:
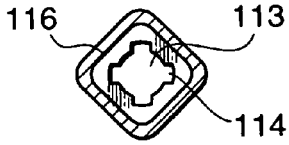
Figure 6B:
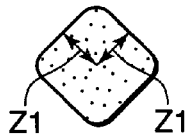
FIGS. 6A–6F are perspective views and main-part sectional views of a stick-form cosmetic material and a holder according to the second embodiment of this invention.

As shown in FIG. 6B, the stick-form cosmetic material B in this embodiment has a substantially square cross-section with rounded corners over its entire length. As shown in FIG. 5B, a hollow portion 112 of the sleeve 110 takes a similar form with a slight clearance from the stick-form cosmetic material B, thereby enabling the stick-form cosmetic material B to be displaced axially. Here, the sectional dimension of the hollow portion 112 is expressed as a distance Z from the center to the nearest wall surface.

The core chuck member 130 is constituted by the holder 131, which is capable of axial displacement within the hollow portion 112 of the sleeve 110 and has an outer form having a substantially square cross-section with a dimension Z2, and the stick shaft 134, which is fixed to the holder 131. The holder 131 is constituted by a cylindrical portion 132 formed from a thin film, and a thick bottom portion 133. The inner periphery of the cylindrical portion 132 has a substantially square cross-section with a dimension Z1. The cross-section of the stick-form cosmetic material B is also set at Z1. The value of Z2 is set to be larger than the value of Z1 by an amount corresponding to the wall thickness of the cylindrical portion 132 and the value of Z is set to be slightly larger than the value of Z2.

Figure 6D:
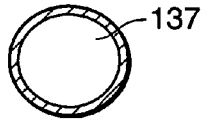
Figure 6A:
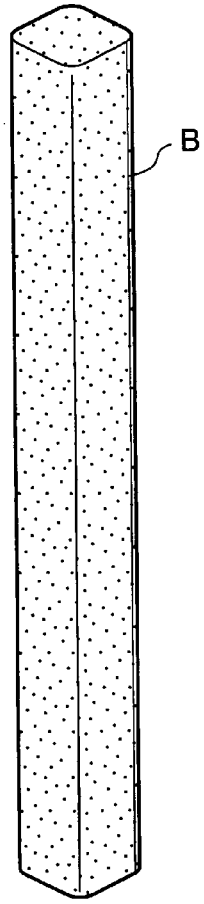
Figure 6C:
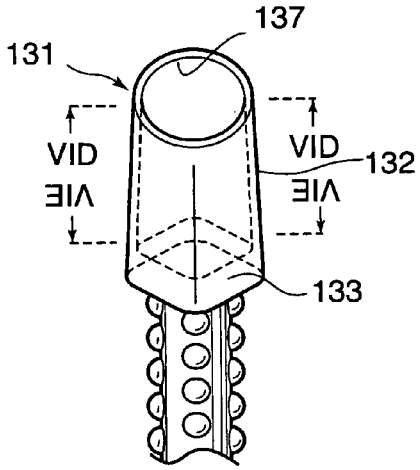
Figure 6F:
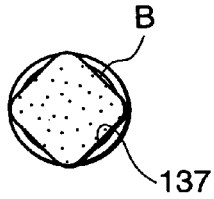
Figure 6E:
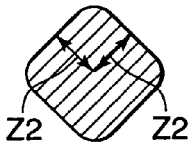

In this embodiment, similarly to the first embodiment, an upper end opening portion 137 of the cylindrical portion 132 of the holder 131 tends to have a sectional form that is closer to a circular form, as shown in FIG. 6D, than the designed, substantially square cross-section. This difference in form causes an obstruction when the stick-form cosmetic material B is inserted into the cylindrical portion 132 through the upper end opening portion 137 as shown in FIG. 6F.

However, when the core chuck member 130 is inserted into the sleeve 110 during assembly of the stick-form cosmetic material feeding container 101, the outer periphery of the deformed upper end opening portion 137 of the holder 131 contacts the inner periphery of the sleeve 110, which has a substantially square cross-section, thereby correcting the sectional form of the upper end opening portion 137. As a result, when the stick-form cosmetic material B is attached to the holder 131 after the stick-form cosmetic material feeding container 101 is assembled, the upper end opening portion 137 of the holder 131 does not cause an obstruction when the stick-form cosmetic material B is inserted into the cylindrical portion 132.

Hence in this embodiment, similar favorable effects to those of the first embodiment can be obtained.

In the first embodiment, the stick-form cosmetic material A having an elliptical cross-section is used, and in the second embodiment, the stick-form cosmetic material B having a substantially square cross-section is used. However, the stick-form cosmetic material feeding container according to this invention may be applied to a stick-form cosmetic material having another sectional form such as a substantially triangular cross-section, for example. Likewise in this case, the sectional form of the sleeve and holder is made identical to the sectional form of the stick-form cosmetic material, and dimensions are set appropriately such that the form of the upper end opening portion of the holder is corrected through contact with the inner peripheral surface of the sleeve.

It should be noted that the degree by which the opening portion is deformed from its designed sectional form when in a free condition increases steadily as the thin film constituting the cylindrical portion of the holder decreases in thickness. When the cylindrical portion is formed by injection-molding a thermoplastic material, the minimum wall thickness thereof is 0.05 mm. When the opening portion is deformed excessively, an appropriate degree of deformation can be obtained by increasing the wall thickness.

However, as the degree of deformation is reduced by increasing the wall thickness, the rigidity of the cylindrical portion increases. As a result, the operating sensation produced when the cylindrical portion is displaced while in contact with the inner periphery of the sleeve deteriorates. Therefore, the wall thickness of the cylindrical portion is preferably set in accordance with the texture of the stick-form cosmetic material.

As described above, a prerequisite of the prior art was that the holder must not contact the inner periphery of the sleeve, whereas in this invention, the holder is constituted to be capable of elastic deformation on the premise that the holder contacts the inner periphery of the sleeve, and hence there is no need to form the step in the outer periphery of the stick-form cosmetic material that is accommodated in the holder. Moreover, the holder can be prevented from swaying during axial displacement thereof within the sleeve.

In the first and second embodiments, the male screw-form protrusions 35, 135 are provided in a large number along a spiral path, but logically, as long as at least one male screw-form protrusion 35, 135 is provided so as to engage with the female screw portion 23, the holder 31, 131 can be fed and withdrawn.

Next, referring to FIGS. 7A and 7B, FIGS. 8A–8E, FIGS. 9A–9E, and FIGS. 10A–10C, a third embodiment of this invention will be described.

Figure 7A:
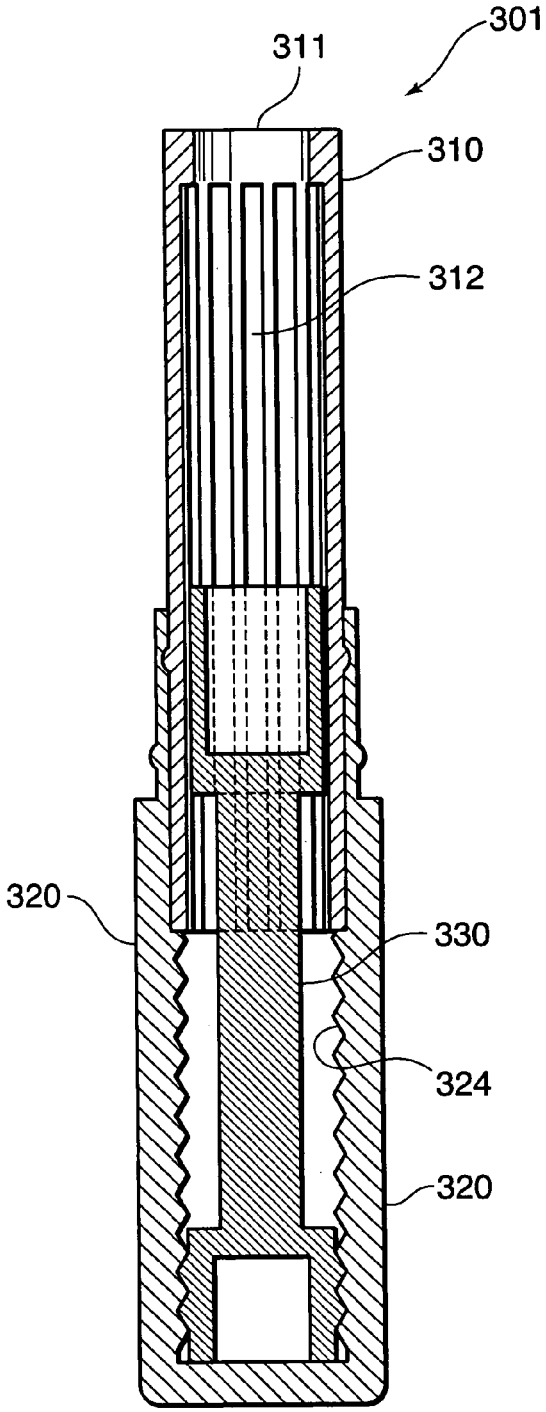
FIGS. 7A and 7B are longitudinal sectional views of a stick-form cosmetic material feeding container according to a third embodiment of this invention.
Figure 7B:
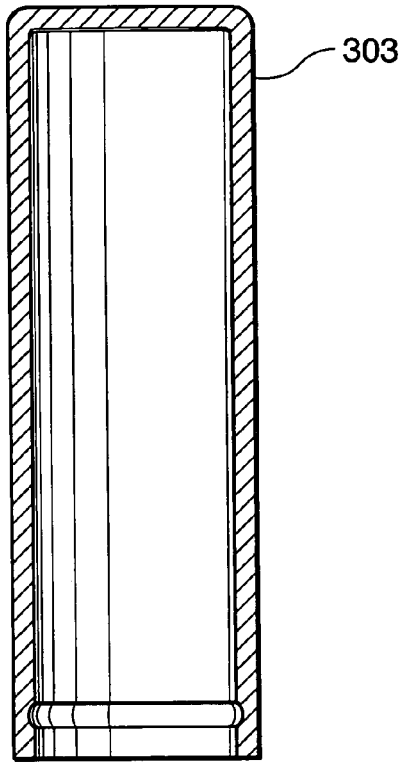

Referring to FIGS. 7A and 7B, a stick-form cosmetic material feeding container 301 comprises a sleeve 310, a main body tube 320 which engages with the lower end of the sleeve 310, a core chuck member 330 which protrudes into the main body tube 320 from the sleeve 310, and a removable cap 303 which is fitted over the outer periphery of the sleeve 310. A female screw portion 324 is formed in advance in the inner periphery of the main body tube 320.

Figure 8E:
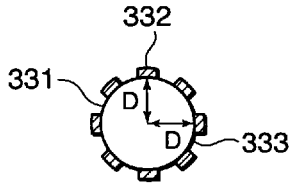
FIGS. 8A–8E are exploded perspective views and main-part sectional views of the stick-form cosmetic material feeding container according to the third embodiment of this invention.
Figure 8A:
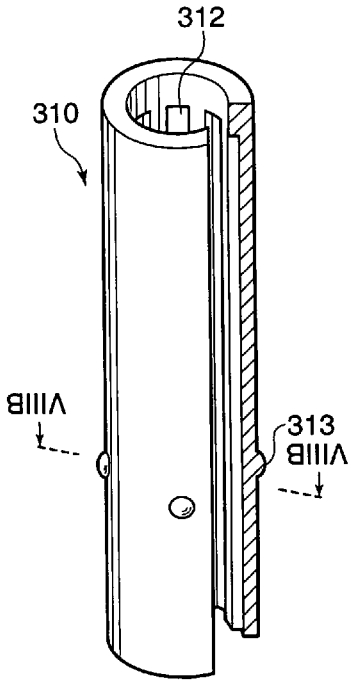
Figure 8C:
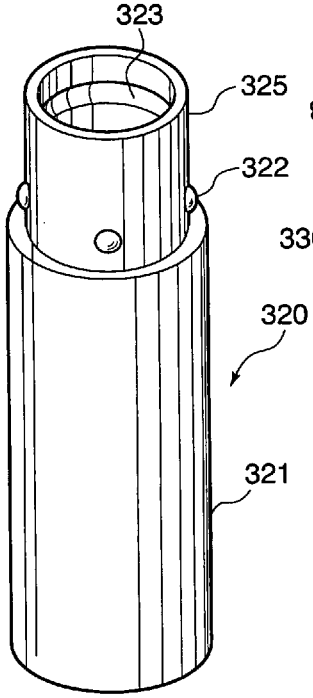

Referring to FIGS. 8A to 8E, the sleeve 310 is a tubular member having a circular cross-section, the inner periphery of which is formed with eight vertical grooves 312 at equal angular intervals. A plurality of engaging protrusions 313 is formed on the outer periphery of the sleeve 310. In FIG. 8A, the sleeve 310 is illustrated in a partly severed form for the purpose of description.

The main body tube 320 comprises a large diameter portion 321 and a small diameter portion 325 to which the cap 303 is attached. The small diameter portion 325 is formed with latching protrusions 322 which engage with an annular groove formed in the lower portion of the cap 303. The lower portion of the sleeve 310 is inserted into the inner periphery of the small diameter portion 325. For this purpose, an annular groove 323 which receives the engaging protrusions 313 is formed in the inner periphery of the small diameter portion 325. The female screw portion 324 is formed in the inner periphery of the large diameter portion 321 over the movement distance of the core chuck member 330.

Figure 8D:
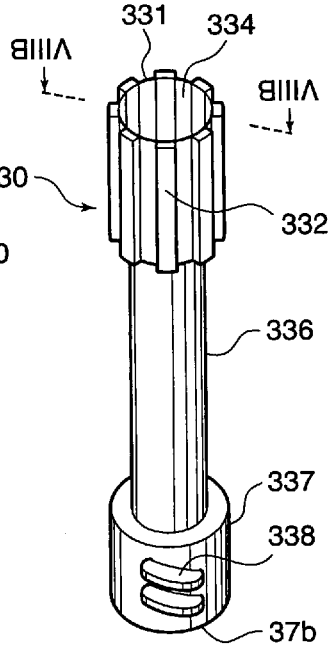
Figure 8B:
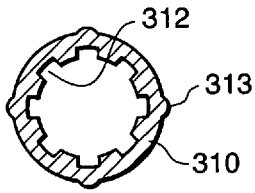

As shown in FIG. 8D, the core chuck member 330 comprises a holder 331, a stick shaft 336, and a cylindrical portion 337.

Figure 10A:
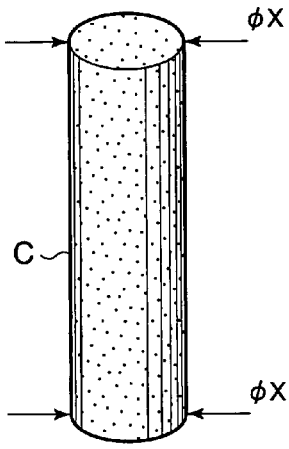
FIGS. 10A–10C are perspective views of a stick-form cosmetic material that may be applied to the stick-form cosmetic material feeding container according to the third embodiment of this invention.

Referring to FIG. 10A, a stick-form cosmetic material C accommodated in the stick-form cosmetic material feeding container 301 is molded into a columnar form having a uniform circular cross-section with a diameter of $\phi X$. The holder 331 which holds the base end of the stick-form cosmetic material C is a tubular member, the inner periphery of which has a circular designed cross-section with a radius $D=\phi X/2$.

The base end of the stick-form cosmetic material C is held inside the holder 331. The outer periphery of the holder 331 is provided with eight strip-form protrusions 332, formed at equal angular intervals in the axial direction, which fit into the vertical grooves 312 in the inner periphery of the sleeve 310. The stick shaft 336 is a cylindrical or columnar shaft member having a smaller diameter than that of the holder 331, and is fixed to the bottom portion of the holder 331.

In this embodiment, the inner periphery of the holder 331 is circular, but four of the eight strip-form protrusions 332, for example, may be caused to protrude slightly into the inner periphery of the holder 331 and used as latching members for latching the stick-form cosmetic material C to the holder 331.

The cylindrical portion 337 is fixed to the lower end of the stick shaft 336. The cylindrical portion 337 comprises screw protrusions 338 on its outer periphery, which are screwed into the female screw portion 324 of the main body tube 320. As shown in FIG. 8D, the screw protrusions 338 are strip-form protrusions inclined in alignment with the incline of the female screw portion 324.

In the stick-form cosmetic material feeding container 301 constituted as described above, the screwing protrusions 338 are displaced spirally along the female screw portion 324 when the sleeve 310 and main body tube 320 are rotated relative to each other, and thus the holder 331 is displaced axially.

The core chuck member 330, including the holder 331, stick shaft 336, and cylindrical portion 337, is formed by injection-molding a thermoplastic material. The cylindrical part of the holder 331, excluding the strip-form protrusions 332, is constituted by a similar thin film to that of the first and second embodiments.

Next, referring to FIGS. 9A–9E, deformation of the holder 331 will be described.

Figure 9B:
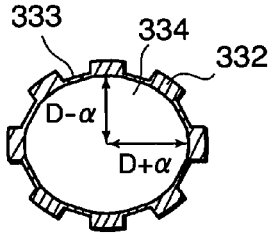
FIGS. 9A–9E are perspective views and enlarged main-part sectional views of a core chuck member according to the third embodiment of this invention.

As shown in FIG. 8E, the holder 331 is designed with a circular cross-section having the radius D. However, when the holder 331 is formed by injection-molding a plastic material such that the eight axial strip-form protrusions 332 are connected by a thin film 333, an upper end opening portion 334 of the holder 331 is formed with a substantially elliptical cross-section having a minor axis $D-\alpha$ and a major axis $D+\alpha$, as shown in FIG. 9B.

More specifically, during injection molding, the molten plastic material flows through the interior of the die from the parts corresponding to the thick strip-form protrusions 332 to the parts corresponding to the thin film 333. At this time, the opening portion 334 deforms due to a difference in the internal stress of the strip-form protrusions 332 and the thin film 333, and to slight movement of a core pin, which is produced by the pressure and flowing speed of the plastic during injection molding and leads to a slightly uneven thickness in the thin film 333. The degree of deformation is not necessarily constant.

Figure 9D:
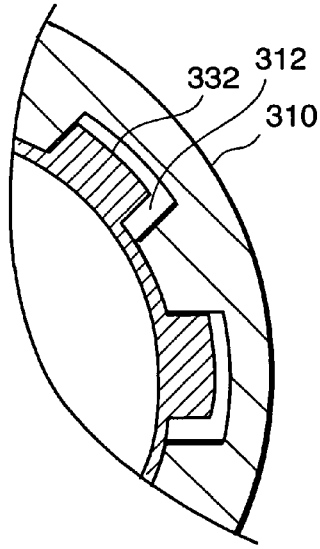
Figure 9A:
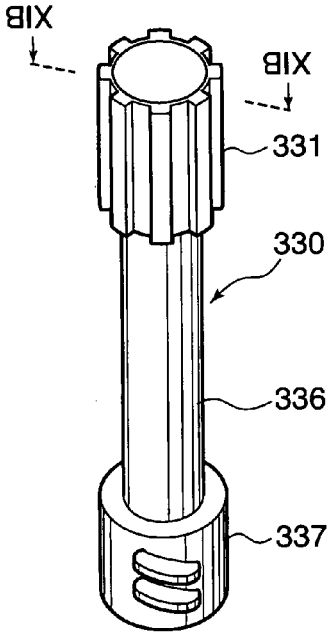
Figure 9C:
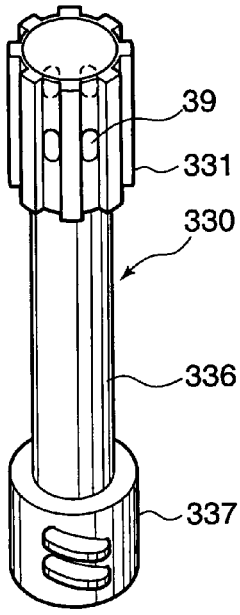

If an opening window 39 is provided on the side face of the holder as shown in FIG. 9C, movement of the core pin of the die due to the pressure and flowing speed of the plastic during injection molding can be prevented. This prevention effect is more notable as the thin film 333 becomes thinner.

The thin film 333 is preferably made as thin as possible, as long as the opening portion 334 is not damaged and the stick-form cosmetic material C can be held thereby. The thickness of the thin film 333 preferably has a minimum value of 0.05 mm and a maximum value of 0.3 mm. As the thickness of the thin film 333 decreases, the degree of deformation in the opening portion 334 increases. According to research conducted by the inventors, when the thickness of the thin film 333 was set to 0.1 mm at the upper end portion of the holder 331 and 0.2 mm at the bottom portion, the thickness of the thin film was altered by a slight movement of the core pin such that at a certain site on the upper end portion, the thickness was 0.08 mm, and at a certain site on the bottom portion, the thickness was 0.18 mm. Thus at these sites, the thickness decreased below the set thickness. At another certain site on the upper end portion, the thickness was 0.12 mm, and at another certain site on the bottom portion, the thickness was 0.22 mm. Thus at these sites, the thickness increased beyond the set thickness. This variation in the thickness of the thin film 333 causes the opening portion 334 to deform.

The stick-form cosmetic material feeding container 301 is assembled in the following manner.

First, the core chuck member 330 is inserted into the sleeve 310 from the lower end opening portion of the sleeve 310 while fitting the strip-form protrusions 332 into the vertical grooves 312. Next, the core chuck member 330 is screwed to the main body tube 320 from the cylindrical portion 337, whereupon the sleeve 310 and main body tube 320 are rotated relative to each other to insert the cylindrical portion 337 into the main body tube 320. Meanwhile, the sleeve 310 is inserted into the main body tube 320, and the engaging protrusions 313 of the sleeve 310 are engaged to the annular groove 323 of the small diameter portion 325.

Figure 9E:
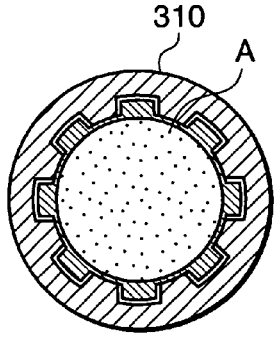

When the core chuck member 330 is inserted into the sleeve 310 during this process, the deformed opening portion 334 contacts the inner peripheral surface and vertical grooves 312 of the sleeve 310 as shown in FIG. 9D, and as a result, its substantially elliptical cross-section is corrected to a circular cross-section. Accordingly, when the stick-form cosmetic material C is inserted into the holder 331 after the stick-form cosmetic material feeding container 301 is assembled, the stick-form cosmetic material C having a circular cross-section can be inserted into the opening portion 334, which has been corrected to a circular cross-section, without obstruction, as shown in FIG. 9E. The stick-form cosmetic material C inserted into the holder 331 supports the holder 331 from the inside, and increases the rigidity of the holder 331.

Only the thin film 333 is interposed between the stick-form cosmetic material C and the inner peripheral surface of the sleeve 310, and therefore an appropriate clearance is maintained between the inner peripheral surface of the sleeve 310 above the holder 331 and the stick-form cosmetic material C even when no step is provided on the outer periphery of the stick-form cosmetic material C for inserting the stick-form cosmetic material C into the holder 331.

Further, since the holder 331 contacts the inner peripheral surface and vertical grooves 312 of the sleeve 310 when inserted into the sleeve 310, the core chuck member 330 inserted into the sleeve 310 does not fall out of the sleeve 310 naturally. Moreover, since the holder 331 contacts the inner periphery of the sleeve 310, the stick-form cosmetic material C can be prevented from swaying in a horizontal direction during a feeding or withdrawal operation. Also, due to the frictional resistance between the holder 331 and sleeve 310, the stick-form cosmetic material feeding container 301 may be provided with a favorable operating sensation. Hence, similar favorable effects to those of the first and second embodiments can also be obtained in this embodiment.

Figure 10B:
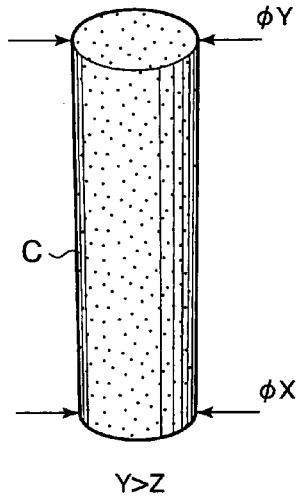
Figure 10C:
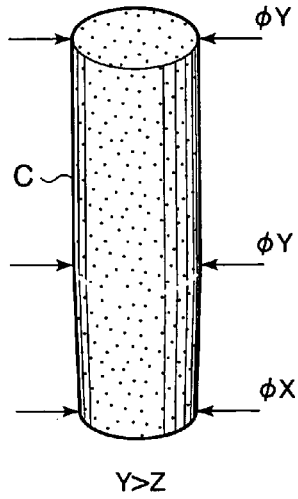
Figure 11A:
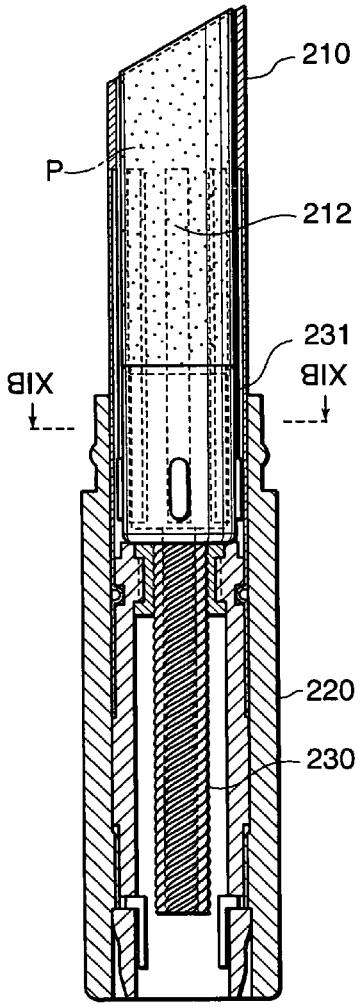
FIG. 11A PRIOR ART
FIGS. 11A–11D are a longitudinal sectional view and a main-part cross-sectional view of a stick-form cosmetic material feeding container, a side view of a stick-form cosmetic material, and a longitudinal sectional view of a core chuck member, according to the prior art.
Figure 11C:
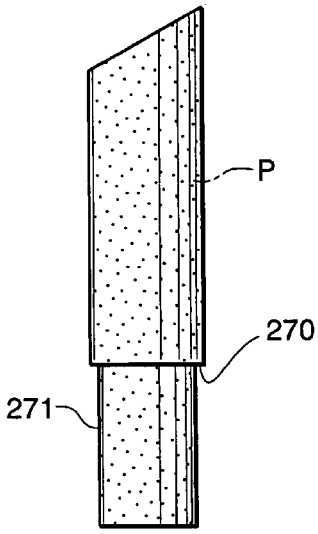
FIG. 11C PRIOR ART
Figure 11D:
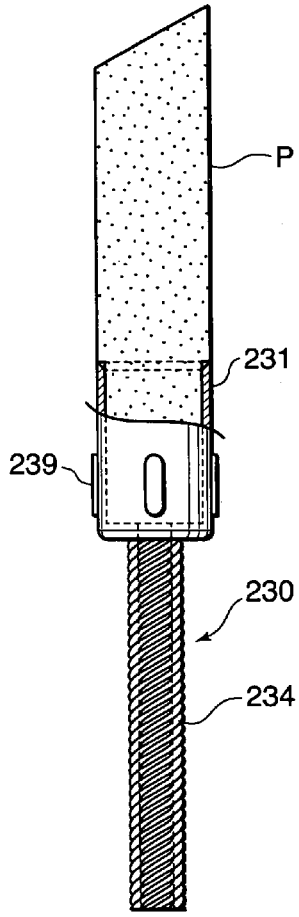
FIG. 11D PRIOR ART
Figure 11B:
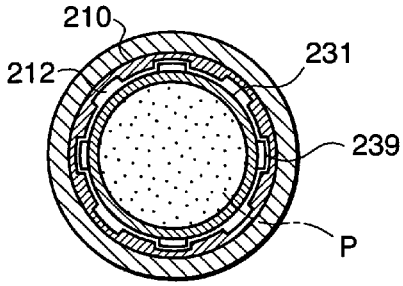
FIG. 11B PRIOR ART

In this embodiment, the stick-form cosmetic material C is formed with a uniform circular cross-section having a diameter of ϕX, but other settings are possible in regard to the form of the stick-form cosmetic material C. As shown in FIG. 10B, for example, the diameter of the stick-form cosmetic material C may be enlarged gradually from the lower end diameter ϕX to an upper end diameter ϕY. Alternatively, the diameter may be enlarged gradually from ϕX to ϕY from the lower end of the stick-form cosmetic material C to the vicinity of the opening portion 334 of the holder 331, and the part that is positioned on the outside of the holder 331 may be set at a uniform diameter of ϕY.

In this embodiment, eight vertical grooves 312 are formed on the inner peripheral surface of the sleeve 310, and eight corresponding strip-form protrusions 332 are formed on the outer periphery of the holder 331, but the number of combinations of the vertical groove 312 and strip-form protrusion 332 is not limited to eight, and four or six combinations may be provided, for example. The function of permitting axial displacement of the sleeve 310 relative to the holder 331 while restricting relative rotation therebetween can be achieved with at least one combination of the vertical groove 312 and strip-form protrusion 332.

As can be understood from the above description, the essential features of the feeding container 1 (101, 301) for a stick-form cosmetic material according to this invention are a tubular holder 31 (131, 331) comprising a thin film that is capable of elastic deformation, and having an opening portion 37 (137, 334) which in a free condition takes a dissimilar form to the cross-section of the stick-form cosmetic material, and a sleeve 10 (110, 310) which accommodates the holder 31 (131, 331) and corrects the form of the opening portion of the holder such that stick-form cosmetic material can be inserted into the holder. Other features of the embodiments are optional.

The contents of Tokugan 2005-057194, with a filing date of Mar. 2, 2005, in Japan and Tokugan 2005-136202, with a filing date of May 9, in Japan are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

The embodiments of this invention in which an exclusive property or privilege is claimed are defined as follows:

What is claimed is:

1. A feeding container for a stick-form cosmetic material, comprising:

a main body tube;

a sleeve connected with the main body tube so as to be free to rotate but not to be detachable therefrom;

a core chuck member accommodated in the main body tube and the sleeve;

a mechanism that feeds and retrieves the core chuck member according to the relative rotation of the sleeve and the main body tube; and a tubular holder supported at a tip of the core chuck member inside the sleeve, wherein, the tubular holder comprises a thin film that is capable of elastic deformation and has an opening portion which in a free condition takes a dissimilar form to the cross-section of the stick-form cosmetic material, and the sleeve has such a configuration that forcibly corrects the form of the opening portion of the tubular holder such that stick-form cosmetic material can be inserted into the tubular holder.

2. The feeding container as defined in claim 1, wherein the sleeve has an inner peripheral surface, and corrects the form of the opening portion of the tubular holder through the contact of the inner peripheral surface and the opening portion of the tubular holder.

3. The feeding container as defined in claim 1, wherein the stick-form cosmetic material can be inserted into the tubular holder accommodated in the sleeve via an opening portion of the sleeve.

4. The feeding container as defined in claim 1, wherein a cross-section of the inner peripheral surface of the sleeve is formed in a similar form to a cross-section of the stick-form cosmetic material.

5. The feeding container as defined in claim 1, wherein the tubular holder is formed by injection-molding a plastic material.

6. The feeding container as defined in claim 1, wherein a thickness of the thin film is set within a range of 0.05 millimeters to 0.3 millimeters.

7. The feeding container as defined in claim 1, further comprising a member which restricts relative rotation between the sleeve and the tubular holder.

8. The feeding container as defined in claim 1, wherein the tubular holder comprises strip-form protrusions formed axially at equal angular intervals and a thin film which connects the strip-form protrusions in a circumferential direction, and the sleeve comprises vertical grooves on the inner circumference thereof so as to guide the protrusions of the tubular holder.

* * * * *